US007228914B2

(12) United States Patent
Chavers et al.

(10) Patent No.: US 7,228,914 B2
(45) Date of Patent: Jun. 12, 2007

(54) INTERVENTIONLESS RESERVOIR CONTROL SYSTEMS

(75) Inventors: Raymond D. Chavers, Humble, TX (US); Graeme J. Walker, Kingwood, TX (US); John M. Cobb, Humble, TX (US); Alfredo Gomez, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 167 days.

(21) Appl. No.: 10/783,404

(22) Filed: Feb. 20, 2004

(65) Prior Publication Data

US 2005/0092501 A1 May 5, 2005

Related U.S. Application Data

(60) Provisional application No. 60/516,882, filed on Nov. 3, 2003.

(51) Int. Cl.
*E21B 33/12* (2006.01)

(52) U.S. Cl. ..... 166/386; 166/332.1

(58) Field of Classification Search ..... 166/114, 166/142, 143, 148, 150, 151, 152, 184, 316, 166/332.1, 373, 374, 386
See application file for complete search history.

(56) References Cited

U.S. PATENT DOCUMENTS

| | | | | |
|---|---|---|---|---|
| 3,375,874 | A * | 4/1968 | Cherry et al. | 166/114 |
| 3,493,052 | A * | 2/1970 | Boehm et al. | 166/373 |
| 3,970,147 | A * | 7/1976 | Jessup et al. | 166/374 |
| 4,274,486 | A * | 6/1981 | Fredd | 166/373 |
| 4,440,221 | A | 4/1984 | Taylor et al. | 166/106 |
| 4,453,599 | A | 6/1984 | Fredd | 166/374 |
| 5,048,611 | A * | 9/1991 | Cochran | 166/374 |
| 5,109,925 | A | 5/1992 | Stepp et al. | 166/184 |
| 6,109,356 | A | 8/2000 | Echols et al. | 166/386 |
| 6,325,143 | B1 * | 12/2001 | Scarsdale | 166/54.1 |
| 6,325,153 | B1 | 12/2001 | Harrell | 166/386 |
| 6,334,486 | B1 | 1/2002 | Carmody et al. | 166/53 |
| 6,378,612 | B1 | 4/2002 | Churchill | 166/319 |
| 2001/0015277 | A1 | 8/2001 | Vaynshteyn et al. | 166/387 |

* cited by examiner

*Primary Examiner*—Jennifer H. Gay
*Assistant Examiner*—Daniel P Stephenson
(74) *Attorney, Agent, or Firm*—Madan, Mossman & Sriram, P.C.

(57) ABSTRACT

Systems and methods for positively closing off a section of wellbore and, thereby providing reservoir control. Systems and methods are described for selectively closing off a section of a wellbore to fluid communication. The wellbore completion section may then be reopened to fluid communication upon reconnection of the upper completion section to the lower completion section. Advantageously, the systems and methods of the present invention generally preclude fluid communication between the annulus of the upper completion section and the flowbore of the lower completion section until the lower completion section is closed off to fluid flow.

20 Claims, 13 Drawing Sheets

INTERVENTIONLESS RESERVOIR CONTROL SYSTEMS

This application claims the priority of U.S. Provisional Patent Application No. 60/516,882 filed Nov. 3, 2003.

BACKGROUND OF THE INVENTION

1. Field of the Invention

The invention relates generally to systems and methods for selectively isolating, or closing of a portion of a wellbore.

2. Description of the Related Art

During operation of a hydrocarbon production well, it is sometimes necessary to close off, or "kill," the well below a certain point, against fluid flow. If the well remains live while, for example, a pump is being removed, pressurized fluid could be forced to the surface very quickly, resulting in a dangerous situation at the wellhead and potentially reducing the ability of the well to produce further. One technique is to kill the well by introducing fluids, such as seawater, at the surface of the well to increase the hydrostatic pressure within the well to a point where it is higher than the formation pressure. The problem with this technique is that it is usually undesirable to introduce fluids into the formation below, as such may reduce the quality and quantity of production fluid that may be obtained from the well later.

A second method for isolating the well is to provide a shut-off valve below the pump that is being removed and then to close the shut-off valve as the pump is removed from the well. A conventional shut-off valve arrangement is a sliding sleeve valve having lateral fluid openings with an internal sleeve that is axially moveable between positions that open and close against fluid communication. A sliding sleeve cut-off valve of this type is described in, for example, U.S. Pat. No. 5,156,220 issued to Forehand et al. and U.S. Pat. No. 5,316,084 issued to Murray et al. Each of these patents are owned by the assignee of the present invention and are hereby incorporated by reference. A shut-off valve assembly of this type is also available commercially from the Baker Oil Tools division of Baker Hughes Incorporated as the Model "CMQ-22" Sliding Sleeve.

This procedure for opening and closing the shut-off valve, while simple, presents practical problems. Because the well is live, there is typically a significant pressure differential across the shut-off valve. The inventors have recognized that, if the valve is not positively closed at the time the pump is removed, pressure may escape from the well below the pump. With the procedure where the sleeve element is closed by pulling the pump from the well, the valve is not fully closed until the pump is raised some distance within the wellbore, thereby permitting such an escape of pressure.

The present invention addresses the problems of the prior art.

SUMMARY OF THE INVENTION

The invention provides improved systems and methods for positively closing off a section of wellbore and, thereby providing reservoir control. Systems and methods are described for selectively closing off a section of a wellbore to fluid communication. The wellbore completion section may then be reopened to fluid communication upon reconnection of the upper completion section to the lower completion section. Advantageously, the systems and methods of the present invention generally preclude fluid communication between the annulus of the upper completion section and the flowbore of the lower completion section until the lower completion section is closed off to fluid flow.

In one preferred embodiment described herein, a reservoir control valve assembly is provided having upper and lower sliding sleeves that are incorporated into the upper and lower completion sections of a reservoir completion. The upper sliding sleeve is selectively opened by increased annulus pressure, so that fluid flow may be prevented until it is desired to begin flow, thereby affording positive control over the reservoir completion. The lower sliding sleeve is actuated by removal of the upper completion section from the lower completion section and by replacement of the upper completion section upon the lower completion section.

A second preferred reservoir control system is described wherein the reservoir control valve assembly includes a valve body that incorporates both an inner and an outer sliding sleeve. The outer sleeve is opened by an increase in annular pressure within the wellbore. The inner sleeve is opened by manipulation of the upper completion section to cause a stinger member to actuate the inner sleeve.

The systems and method of the present invention are interventionless in the sense that there is no need to utilize a wireline or coiled tubing-run device to open of close off the lower completion section prior to pulling the upper completion section from the wellbore.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
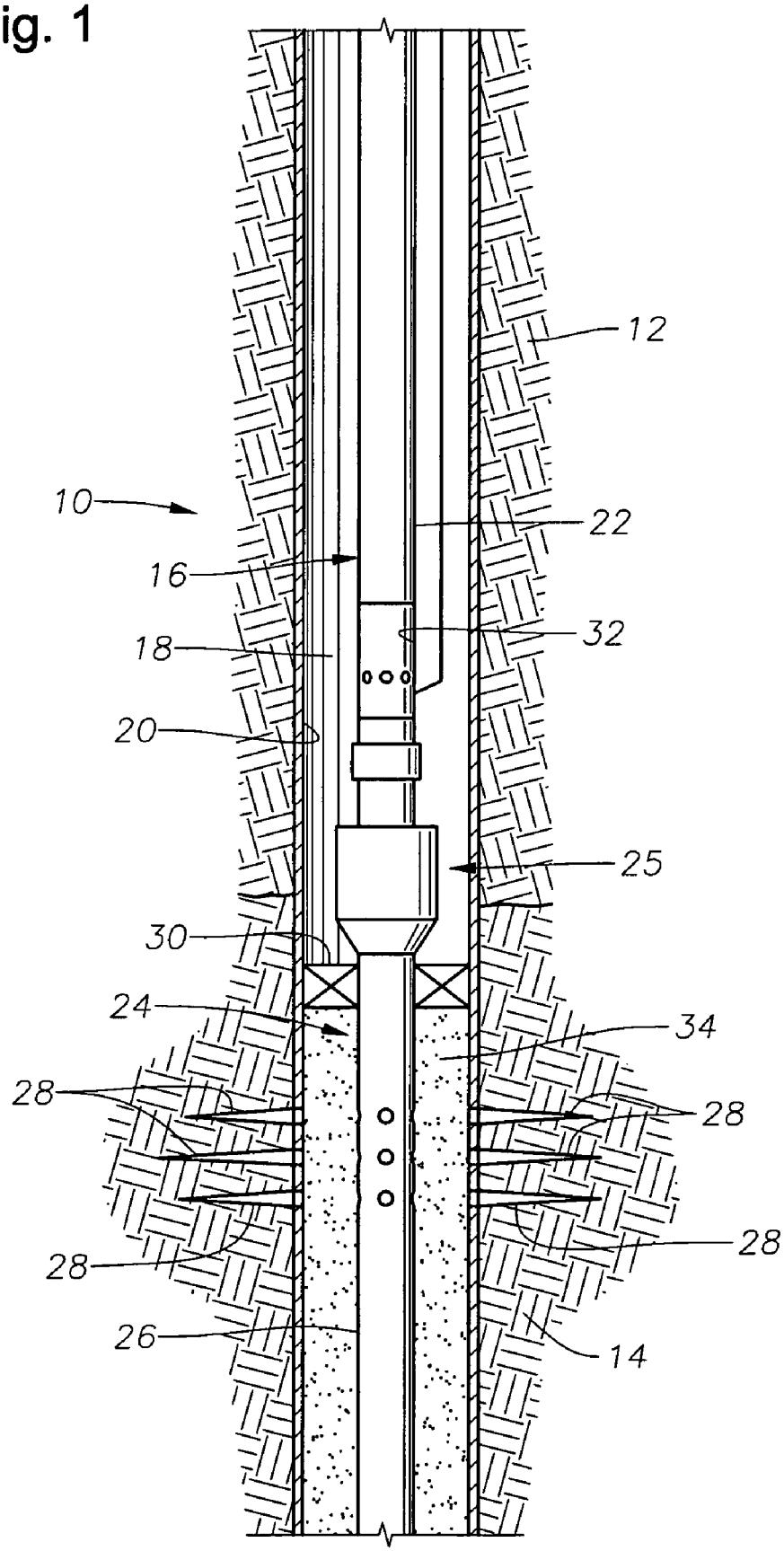
FIG. 1 is a side, cross-sectional view of an exemplary wellbore with a gravel packed section and a completion string disposed therein.

FIG. 1 depicts an exemplary wellbore 10 that has been drilled through the earth 12 to a hydrocarbon-bearing formation 14. The wellbore 10 includes a production tubing-run reservoir completion string 16 disposed therein and extending to the surface (not shown) of the wellbore 10. An annulus 18 is defined between the completion string 16 and the interior wall 20 of the wellbore 10. The completion string 16 consists of an upper completion portion 22 and a lower completion portion 24, which are reversibly interconnected to one another via a reservoir control valve assembly, generally indicated at 25, the details of which will be described in further detail shortly.

The lower completion portion 24 includes an apertured or screened sub 26 that is disposed adjacent the formation 14. Perforations 28 in the formation 14 help ensure flow of hydrocarbons from the formation 14 into the sub 26. An axial flowbore 32 is defined along the length of the upper and lower completion portions 22, 24. Gravel 34 is packed within the annulus 18 surrounding the sub 26 below a packer assembly 30. During normal operations, hydrocarbons are flowed from the formation 14 into the sub 26 and generally along the flowbore 32 to the surface of the wellbore 10.

Turning now to FIGS. 2, 3, 4 and 5, details of the reservoir control valve assembly 25 and surrounding components are more clearly depicted in a schematic fashion. The upper completion portion 22 includes a tubing string 36 that extends to the surface of the wellbore 10. An electric submersible pump 38 is secured to the lower end of the tubing string 36. The pump 38 is of a type known in the art for flowing hydrocarbons along a production string and includes a motor section 40 and inlet section 42. The inlet section 42 contains a number of fluid inlets 44 that permit passage of fluid from the annulus 18 into the inlet section 42, wherein it may be transmitted to the surface of the wellbore 10 via the tubing string 36. An electrical cable 46 extends downwardly from the surface of the wellbore 10 and supplies electrical power to the motor section 40 of the pump 38.

Figure 2:
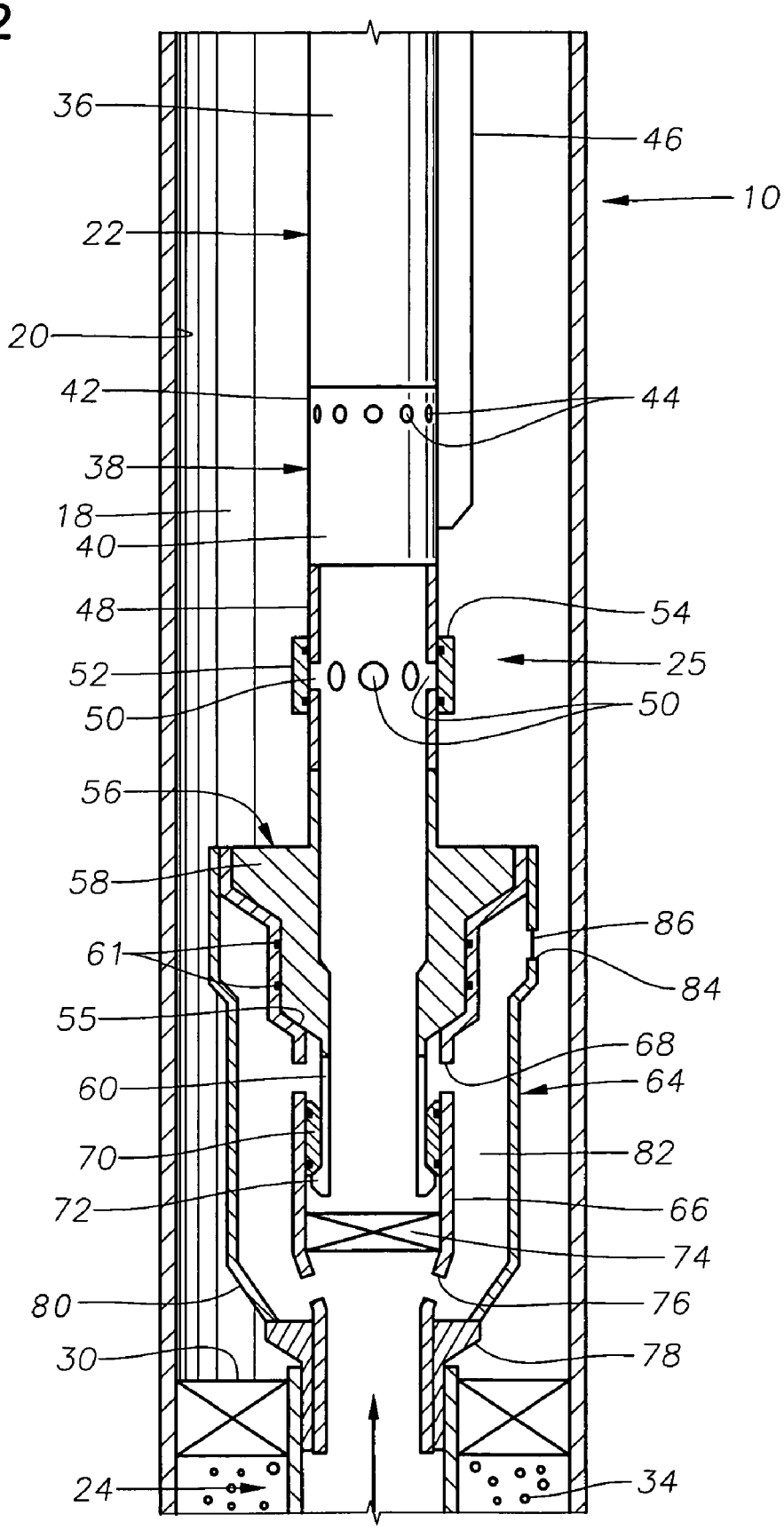
FIG. 2 is an enlarged side, cross-sectional view of the reservoir control system within the wellbore shown in FIG. 1.
Figure 3:
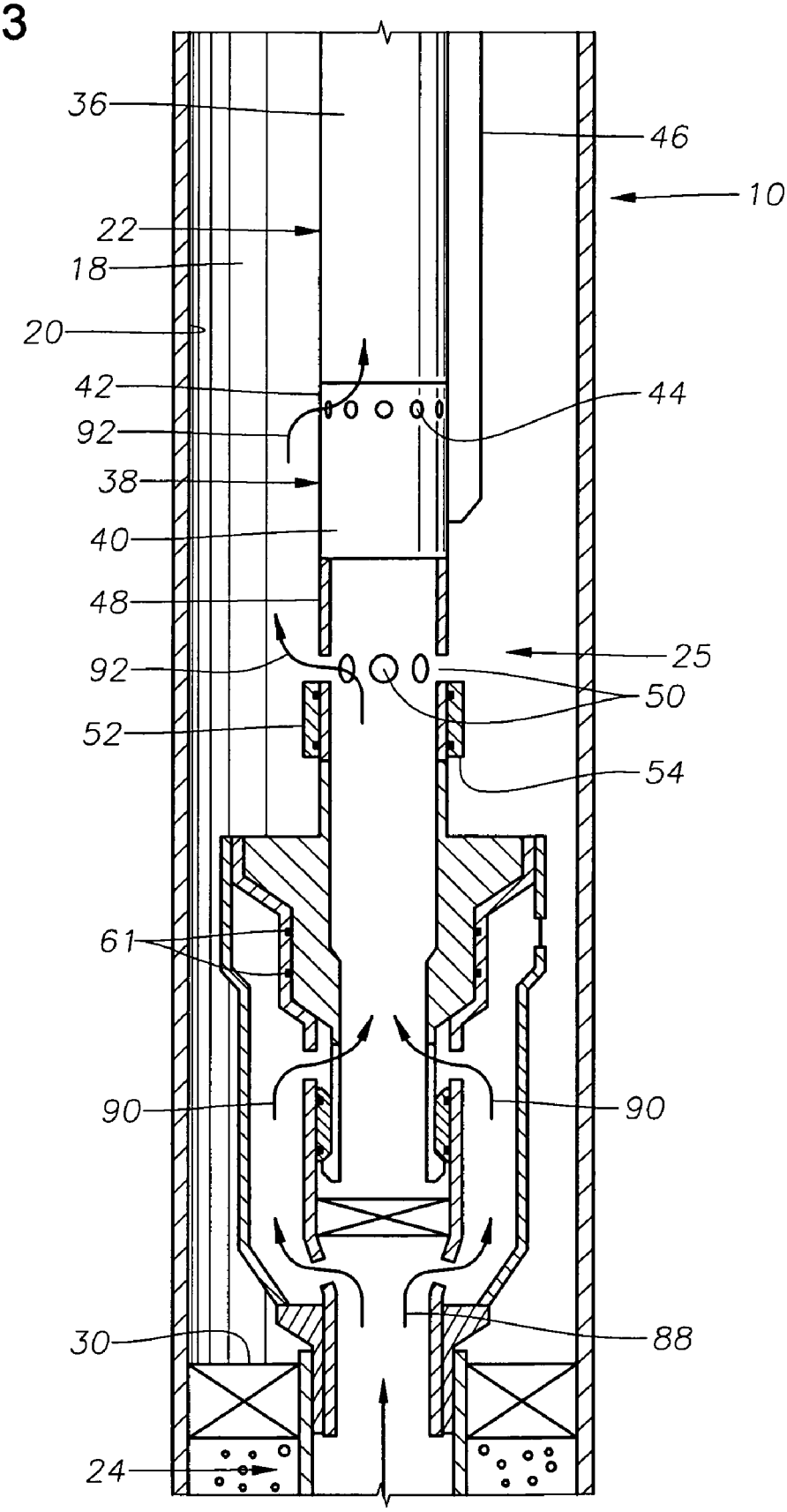
FIG. 3 is a side, cross-sectional view of the reservoir control system shown in FIG. 2, now with the upper sliding sleeve in an open position.

A perforated sub 48 is secured to the lower end of the pump 38. The sub 48 includes a plurality of lateral fluid flow ports 50 disposed therethrough and an upper sliding sleeve 52, which radially surrounds the perforated sub 48 and is axially moveable thereupon to selectively cover and uncover the ports 50. Thereby permitting fluid communication between the annulus 18 and the radial interior of the perforated sub 48. When the reservoir control valve assembly 25 is initially placed into the wellbore 10, the sleeve 52 is in a closed position, as shown in FIG. 2, wherein the ports 50 are covered by the sleeve 52 against fluid flow therethrough. The sliding sleeve 52 is actuatable by increasing fluid pressure within the annulus 18. Increased annular pressure bears upon the piston surface 54 at the upper end of the sleeve 52 to move the sleeve 52 downwardly to the position depicts in FIG. 3, thus opening the ports 50.

An anchor device 56 is secured to the lower end of the perforated sub 48. The anchor device 56 is a snap-in, snap-out anchoring body 58 with a stinger 60 that extends downwardly therefrom. The anchoring body 58 is shaped and sized to reside within a complimentary-shaped receptacle 62. The anchoring body 58 is seated and removed by snapping the body 58 into and out of the receptacle in a manner known in the art. One suitable anchor device for this application is the Model E Snap-In, Snap-Out Anchor that is available commercially from Baker Oil Tools of Houston, Tex. A set of annular elastomeric seals 61 radially surrounds the anchoring body 58 and establishes a fluid seal between the body 58 and the receptacle 62.

The receptacle 62 is defined within a reservoir control valve 64 which includes, below the receptacle 62, a tubular sub 66 having a number of lateral fluid flowports 68 disposed therethrough. An axially moveable lower sliding sleeve 70 is retained within the sub 66. The sliding sleeve 70 is initially disposed within the sub 66 in a first position, shown in FIG. 2, wherein the sleeve 70 does not cover the ports 68 and, thereby, permits fluid to pass through the ports 68. The sleeve 70 is moveable to a second position (shown in FIG. 3) wherein the sleeve 70 covers the ports 68 and thereby blocks fluid flow therethrough. The stinger 60 of the anchor device 56 is equipped with an outwardly projecting profile 72 that is located initially beneath the lower axial end of the sliding sleeve 70. Below the sliding sleeve 70, the tubular sub 66 is closed off to fluid flow therethrough by a flowbore plug 74. The flowbore plug 74 may be of any suitable type. One such suitable plug for this use is the "Extreme" Sur-Set™ plug that is available commercially from Baker Oil Tools of Houston, Tex. Additionally, the tubular sub 66 contains lower lateral fluid ports 76. The lower end of the tubular sub 66 is secured to an anchor member 78 that, in turn, is seated within the packer assembly 30.

The reservoir control valve 64 also includes an outer shroud 80 that radially surrounds that tubular sub 66. An annular space 82 is defined between the shroud 80 and the tubular sub 66. The shroud 80 also includes a fluid opening 84 that is initially closed against fluid flow by a frangible rupture member, such as a burst disc, 86. The frangible member 86 is designed to rupture upon encountering a sufficiently high, predetermined pressure differential.

In operation, the lower completion section 24 is preplaced within the wellbore 10 and the gravel 34 packed into the annulus 18 using well known conventional techniques. The packer assembly 30 is set within the wellbore 10 to close off the annulus 18 below the packer assembly 30. At this point, the upper completion section 22 is run into the wellbore 10 until the anchor 78 is seated and secured within the packer assembly 30, thereby connecting the upper completion section 22 to the lower completion section 24. When this is done, the components of the completion string 16 are in the configuration shown in FIG. 2 wherein the upper sliding sleeve 52 is closed and the lower sliding sleeve 70 is in an open position. In this configuration, no flow of fluid is possible upward to the surface of the wellbore 10 due to the upper sliding sleeve 52 being in a closed position. One advantage of the system and methods of the present invention, then is that of positive reservoir control, wherein no flow is permitted until the system is positively opened for flow.

When it is desired to begin flow of fluid to the surface of the wellbore 10, the upper sliding sleeve 52 is opened. To accomplish this, the tubing string 36 is pressurized. Fluid pressure is thereby also increased in the annulus 18 because of the fluid communication provided by the fluid openings 44 in the pump 38. Increased fluid pressure is brought to bear upon the piston area 54 of the upper sleeve 52, and the sleeve 52 is moved to the open position illustrated in FIG. 3. The pump 38 is then energized in order to flow hydrocarbons from the formation 14 upward through the completion string 16. Hydrocarbon production fluid flows into the lower completion section 24 through apertured sub 26 and then upwardly into through the packer assembly 30 into the tubular sub 66. Due to the presence of the plug 74, the production fluid must exit the tubular sub 66 via fluid flowports 76, as arrows 88 illustrate. Because the lower sliding sleeve 70 is in the open position, the lateral flowports 68 are open to allow the production fluid to reenter the tubular sub 66, as illustrated by arrows 90. The production fluid flows up to the perforated sub 48 and then radially outwardly through perforations 50. The production fluid bypasses the motor section 40 of the pump 38 and enters the inlet section 42 of the pump 38 through fluid inlets 44 to the production tubing 36. This flowpath is illustrated by arrow 92.

Figure 4:
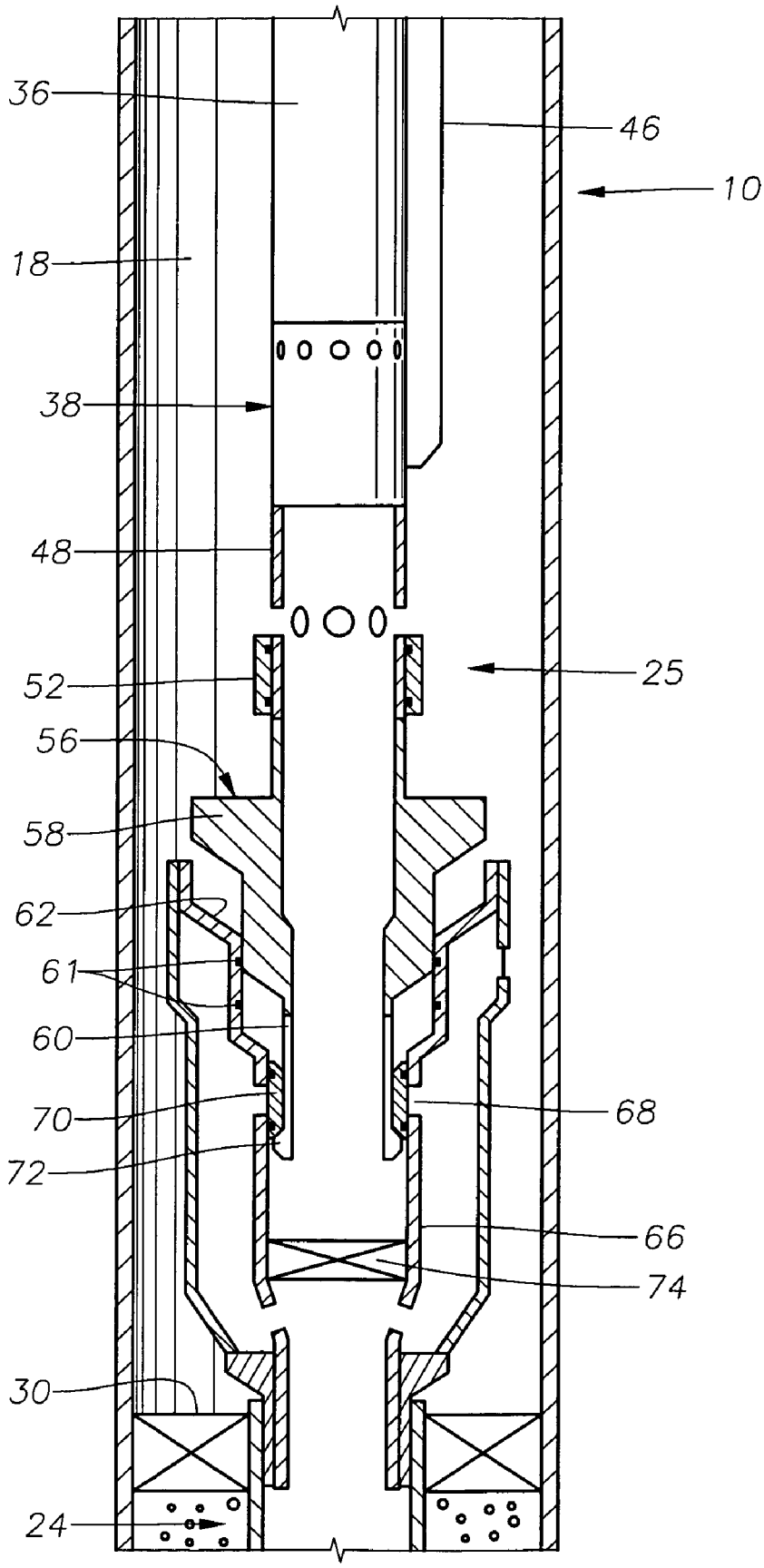
FIG. 4 is a side, cross-sectional view of the reservoir control system shown in FIGS. 2 and 3 now with the lower sliding sleeve having been moved to a closed position.
Figure 5:
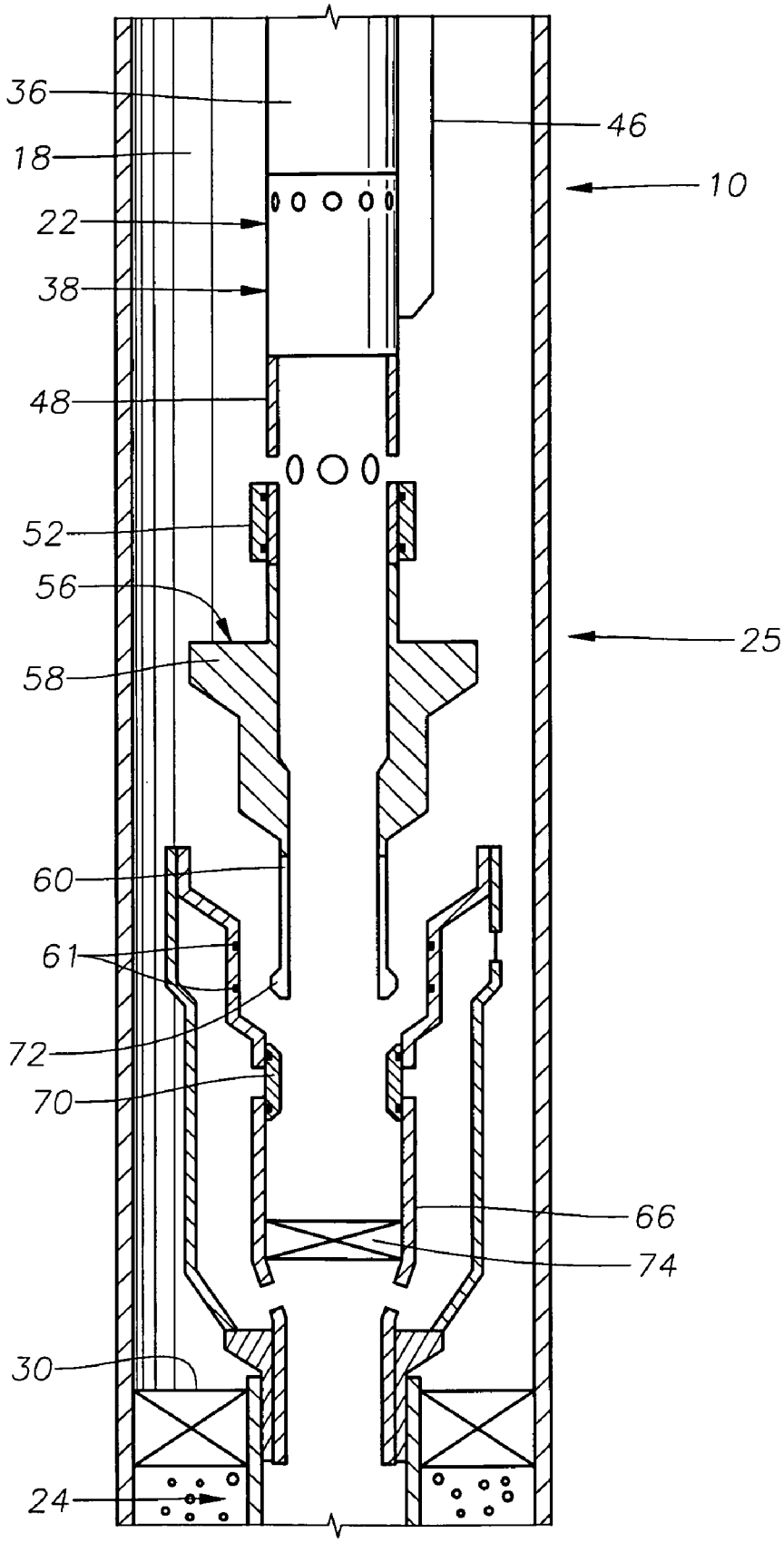
FIG. 5 is a side, cross-sectional view of the reservoir control system shown in FIGS. 2, 3, and 4 now with the upper completion having been fully separated from the lower completion.

The reservoir control valve assembly 25 also provides a mechanism for effectively closing off the lower completion 24 portion of the wellbore 10 while the upper completion portion 22 is removed. This may become necessary if it is required to, for example, replace or repair the pump 38. It is desired that fluid communication between the upper annulus 18 and the flowbore of the lower completion section 24 during or following separation of the upper and lower completion sections 22, 24. Fluids within the upper annulus 18 might enter the flowbore of the lower completion section 24 and, thereby undesirably enter the formation 14. One advantage of exemplary systems and methods of the present invention is that they permit the lower completion to be positively closed without annulus fluids entering the flowbore of the lower completion section 24. FIG. 4, shows the initial stage of separation between the upper completion section 22 and the lower completion section 24. FIG. 5 shows a later stage of separation between the two sections 22, 24. To separate the upper and lower completion sections 22, 24, the tubing string 36 is pulled upwardly causing the anchoring body 58 of the anchor member 56 to snap out of the receptacle 62 of the reservoir control valve assembly 25. The radially outward projection 72 of the stinger 60 engages the lower axial end of the lower sliding sleeve 70 and, as the tubing string 36 is pulled upwardly, the sleeve 70 is moved upwardly to its closed position wherein the flowports 68 are closed to fluid flow, as FIG. 4 shows. It is noted that the presence of seals 61 still ensures a fluid seal between the anchoring body 58 and receptacle 62 at this point. As a result, there is no fluid communication from the annulus 18 into the radial interior of the tubular sub 66 until the lower sleeve 70 is closed. When the lower sleeve 70 is closed, as shown in FIG. 4, the plug 74 and sleeve 70 completely block fluid transmission into the lower completion section 24. Following closure of the sleeve 70, further upward pulling of the tubing string 36 will disconnect the stinger 60 from the lower sleeve 70. The stinger 60 is typically colleted, allowing it to flex radially inwardly to a degree, in a manner well known to those of skill in the art. Therefore, when the tubing string 36 is pulled further upwardly, the stinger 60 will flex inwardly allowing the outward projection 72 to become free of engagement with the lower axial end of the sleeve 70. Once free of this engagement, the upper completion section 22 may be pulled entirely free of the lower completion portion, as depicted in FIG. 5.

Prior to reinserting and reconnecting the upper and lower completion sections 22, 24, the upper sliding sleeve 52 is closed at the surface of the wellbore 10. Once the upper and lower completion sections 22, 24 are reconnected, the upper sliding sleeve 52 may be reopened via an increase in annulus pressure, as previously described. Reinsertion and reconnection of the upper completion section 22 to the lower completion section 24 should automatically reopen the lower sleeve 70. As the upper completion section 22 is lowered into the wellbore, the anchoring body 58 will snap into the receptacle 62. During this process, the outward projection 72 of the stinger 60 will engage the upper axial end of the sleeve 70 and slide it from the closed position, shown in FIG. 5, to the open position, shown in FIG. 3, to once again establish fluid flow into the lower completion section 24. It is noted that, as the upper completion section 22 is reinserted into the lower completion section 24, a fluid seal is first established between the anchoring body 58 and the receptacle 62 via seals 61 prior to opening the lower sliding sleeve 70. This sealing ensures that there is no premature flow of annulus fluids into the lower completion 24.

Figure 6:
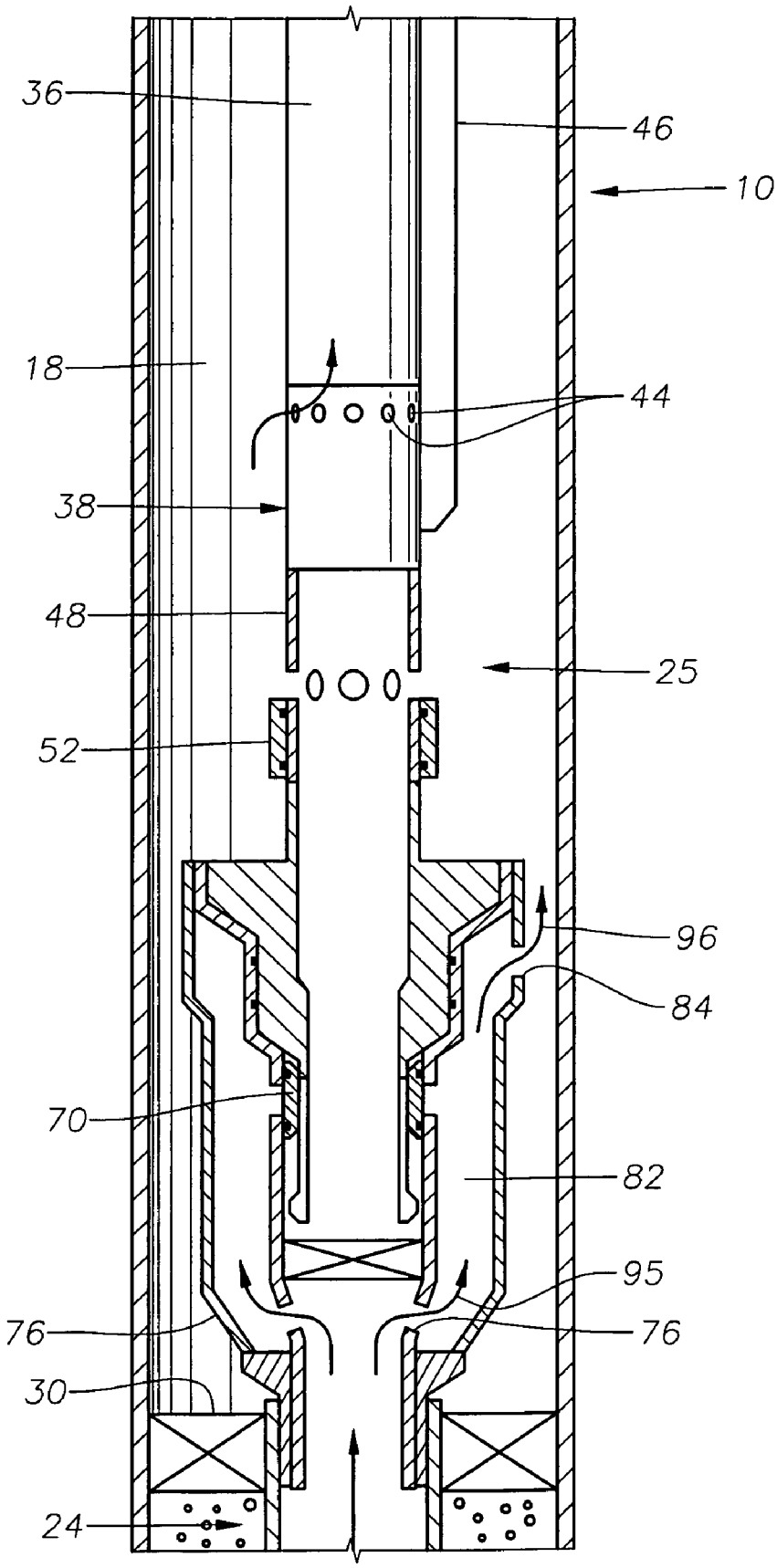
FIG. 6 is a side, cross-sectional view of the reservoir control system shown in FIGS. 2–5, wherein the lower sliding sleeve has been stuck in a closed position.

If the lower sliding sleeve 70 should fail to open, as intended, the burst disc 86 may be ruptured by increasing fluid pressure within the upper portion of the annulus 18 to a level that is great enough to rupture the disc 86 and, thereby, permit fluid to flow through the fluid opening 84. This will provide an additional pathway for fluid to pass between the flowbores of the upper and lower completion sections 22, 24. FIG. 6 depicts this situation. In the event that the lower sleeve 70 is stuck in the closed position, fluid pressure within the upper annulus 18 would be increased to a level sufficient to rupture the burst disc 86, thereby allowing fluid communication through the opening 84 in the shroud 80. Fluid can then pass from the lower completion section 24 through flowports 76 into annular space 82 and then radially outwardly to the annulus 18 through opening 84, as arrows 96 depict. From the annulus 18, the production fluid is then drawn into the fluid inlets 44 of the pump 38 and transmitted to the surface of the wellbore 10 via the tubing string 36. Thus, the fluid opening 84 in the shroud 80 and the burst disc 86 provide an emergency fluid pathway that may be opened in the event of a failure of the lower sleeve 70 to reopen.

Turning now to FIGS. 7–11 as well as 12*a*–12*f* and 13*a*–13*f*, there is shown an alternative reservoir control assembly 100 constructed in accordance with the present invention. FIGS. 7, 8, 9, 10 and 11 are schematic views of the reservoir control system in various stages of operation within the wellbore 10. FIGS. 12*a*–12*f* and 13*a*–13*f* depict the exemplary reservoir control assembly 100 and associated components in quarter cross-section so that the interoperation of the various components may be appreciated. Referring first to the schematic views (FIGS. 7–11), the overall structure and operation of the reservoir control assembly 100 will be described. The reservoir control assembly 100 is affixed within an upper completion section 102 below an electrical submersible pump 104. The lower completion section 106 includes the perforated pipe 24 and gravel packed section 34. The packer 30 has an upwardly-extending latching portion 108 for landing and releasably securing an anchor member thereto.

Generally speaking, the reservoir control assembly 100 includes a generally cylindrical valve body 110 having an axial fluid passage 112 defined therein. The valve body 110 includes a radial fluid flow port 114 and carries an exterior sliding sleeve valve member 116 that is selectively moveable between two positions. In the first position (shown in FIG. 7), the flow port 114 is blocked by the sleeve valve member 116 as against fluid communication. In the second position, the sleeve valve member 116 does not block fluid communication through the flow port 114. Additionally, the valve body 110 includes an inner sliding sleeve valve member 118 that is also moveable between positions in which the valve member 118 respectively blocks and does not block the port 114 against fluid flow. The axial fluid passage 112 of the valve body 110 includes a plug member 120 therewithin to block axial flow of fluid through the passage 112 above the level of the port 114. The upper end of the valve body 110 is provided with an upper latch assembly 122 for interconnection of the valve body 110 to production tubing segments in the upper completion section 102. The lower end of the valve body 110 presents an anchoring portion 124 that is shaped and sized to be complimentary to the latching portion 108 of the packer device 30. The valve body 110 also includes a stinger assembly 126 (visible in the detailed views of 12*a*–12*f* and 13*a*–13*f*) that is used to move the inner sleeve member 118 between its closed and open positions, in a manner that will be described in detail shortly.

Figure 7:
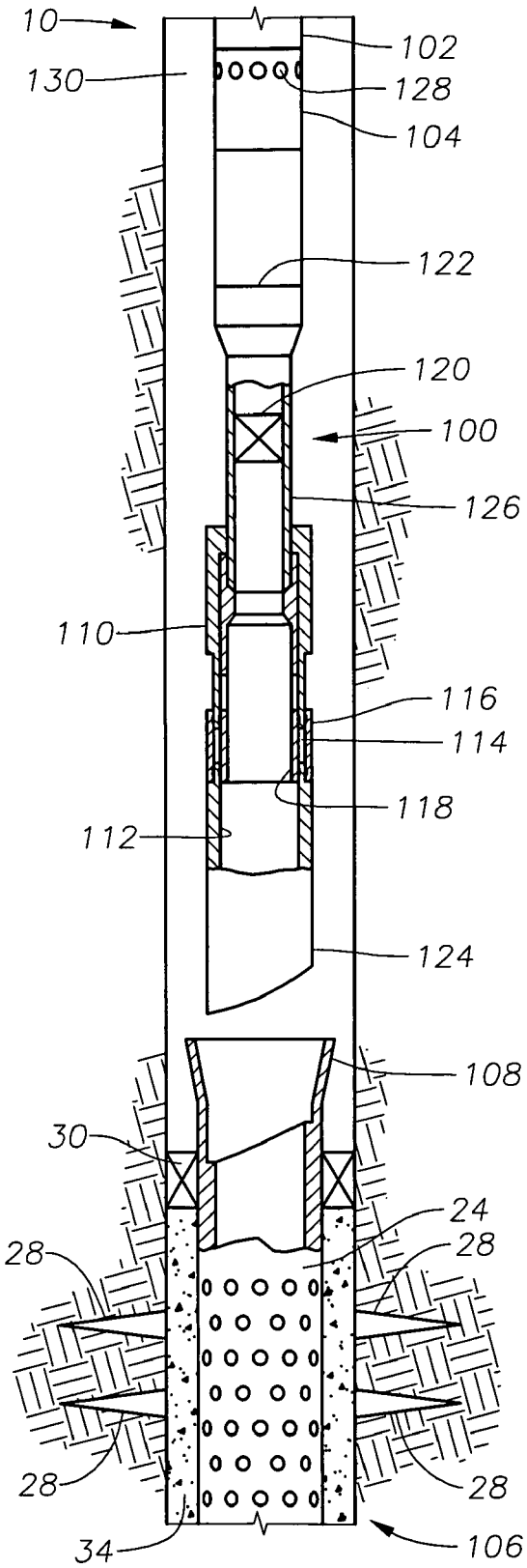
FIG. 7 is a schematic side, cross-sectional view of an alternative reservoir control system constructed in accordance with the present invention wherein there is a gravel-packed section and a completion string disposed within the wellbore.
Figure 8:
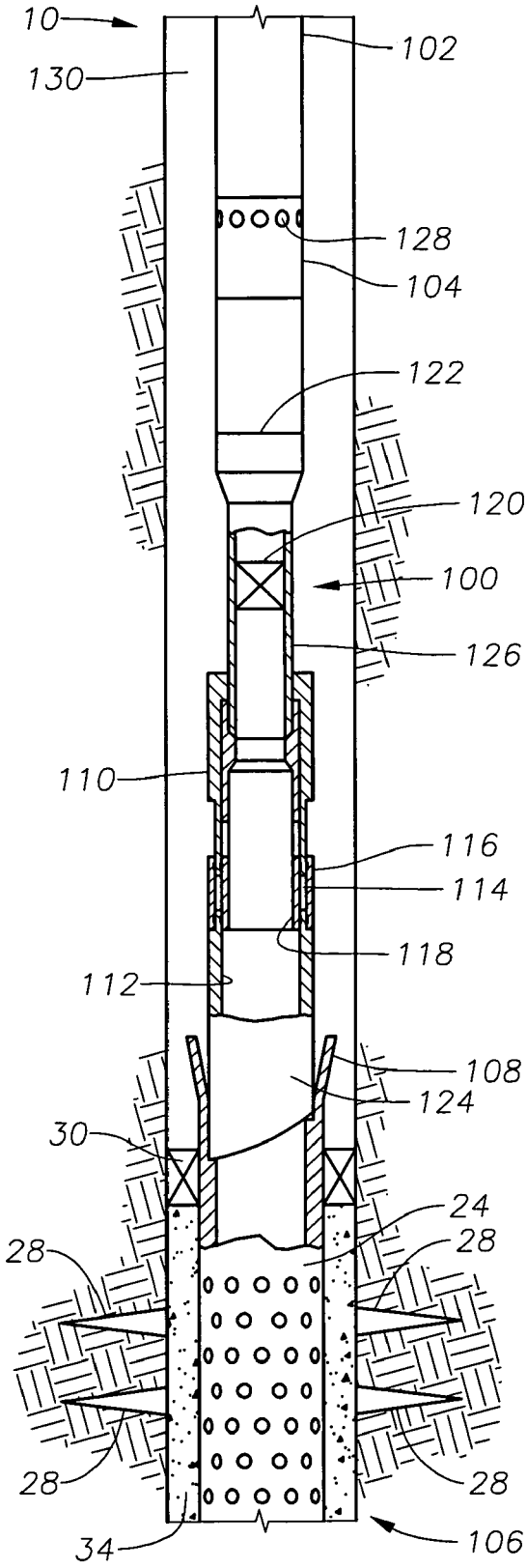
FIG. 8 is a schematic side cross-sectional view of the reservoir control system shown in FIG. 7 wherein the upper completion portion has been landed atop the lower completion portion.
Figure 9:
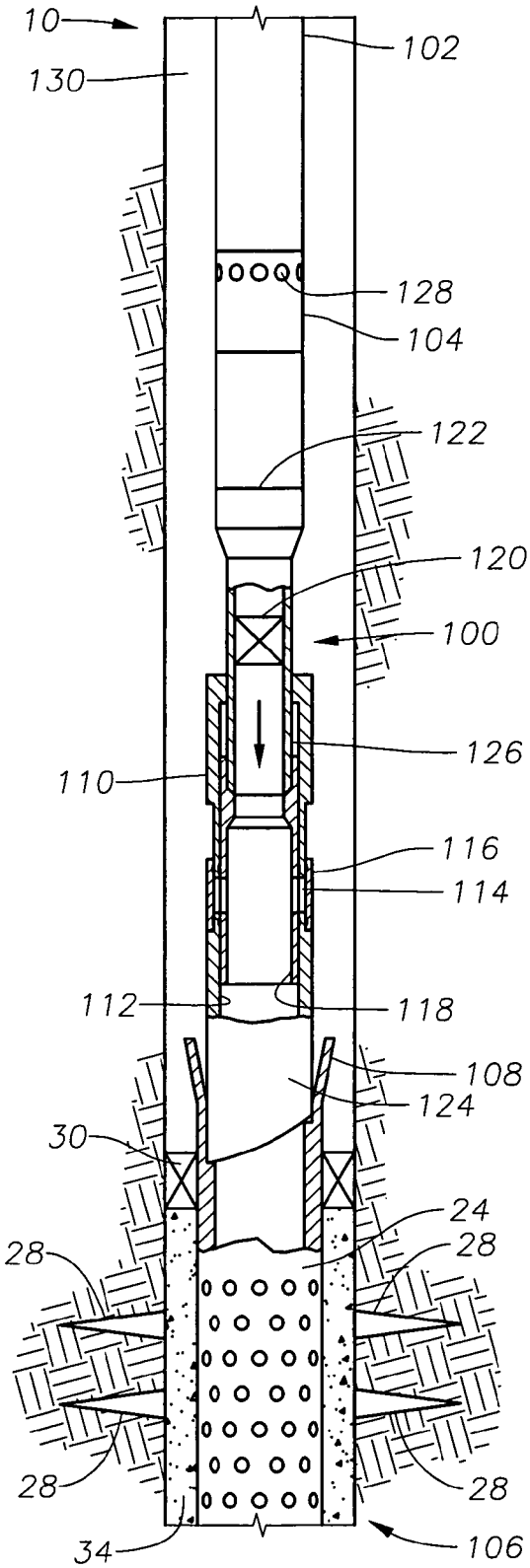
FIG. 9 depicts the reservoir control system of FIGS. 7 and 8 now with the inner sliding sleeve opened.

FIG. 7 illustrates running in of the upper completion section 102 with the reservoir control assembly 100 affixed thereto. In FIG. 8, the anchoring portion 124 of the reservoir control assembly 100 has been landed into the latching portion 108 of the lower completion section 106. In this position, no fluid production from the lower completion section 106 occurs. The plug 120 within the assembly 100 blocks upward flow of fluid. After landing the assembly 100, fluid flow may be started by moving both the inner and outer sleeve members 118, 116 to unblock the port 114. First, the inner sleeve 118 is moved downwardly by surface controlled manipulation of the upper completion 102 string (i.e., pushing downwardly upon the production tubing). The stinger assembly 126 will cause the inner sleeve 118 to open (see FIG. 9). The outer sleeve 116 is then moved to an open position to fully unblock port 114. It is noted, however that the outer sleeve 116 may be opened either before or after the inner sleeve 118 is opened.

Figure 12A:
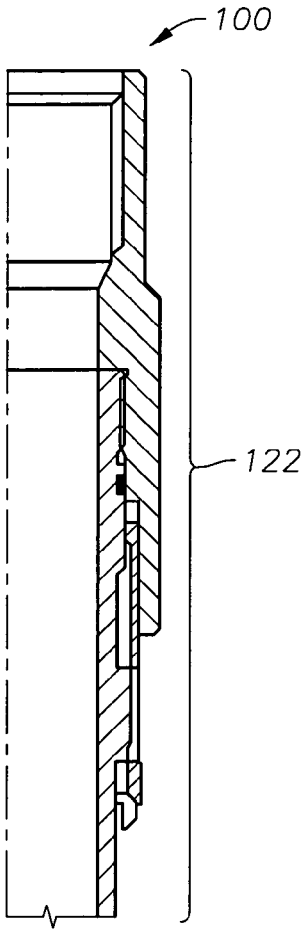
FIGS. 12*a*–12*f* are a quarter-section view of an exemplary reservoir control valve used within the system described with respect to FIGS. 7–11.
Figure 12B:
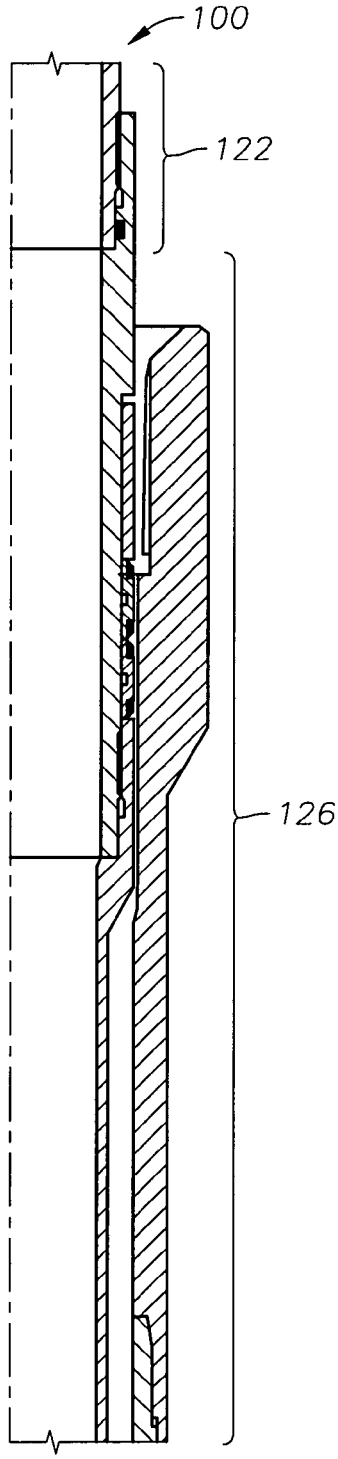
Figure 12C:
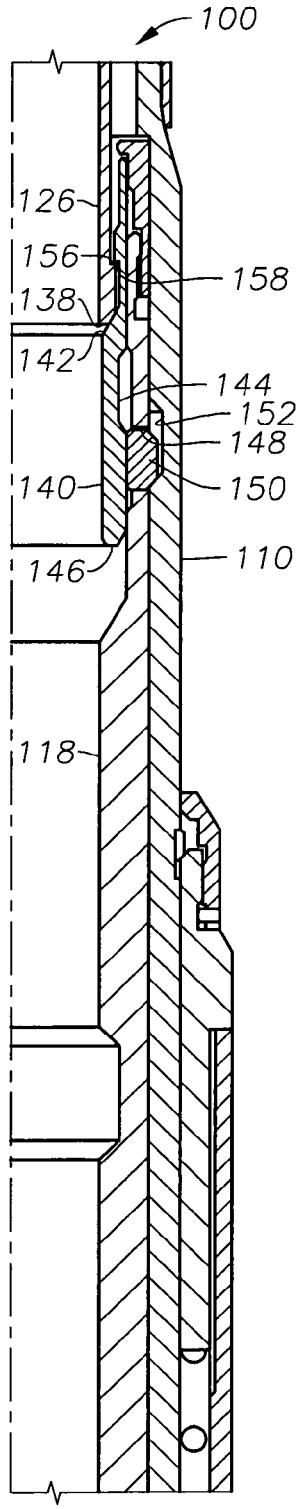
Figure 12D:
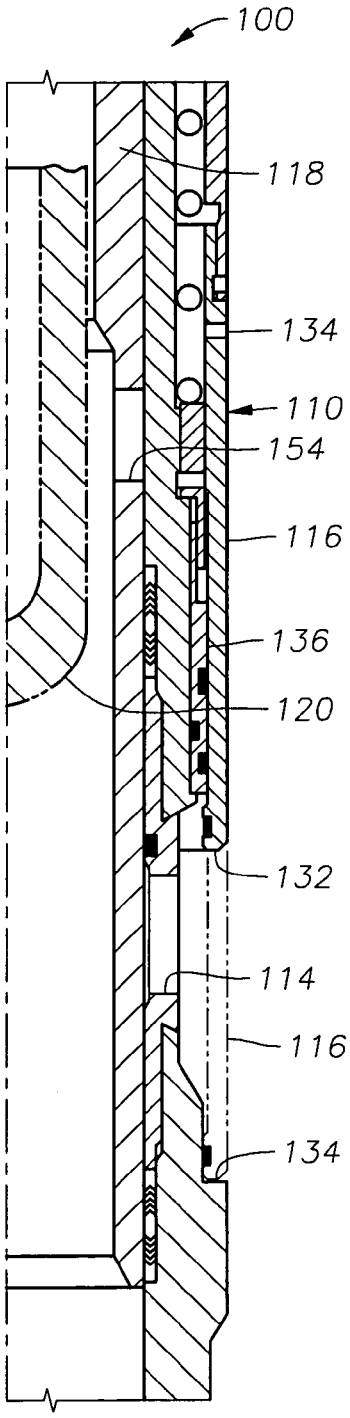
Figure 12E:
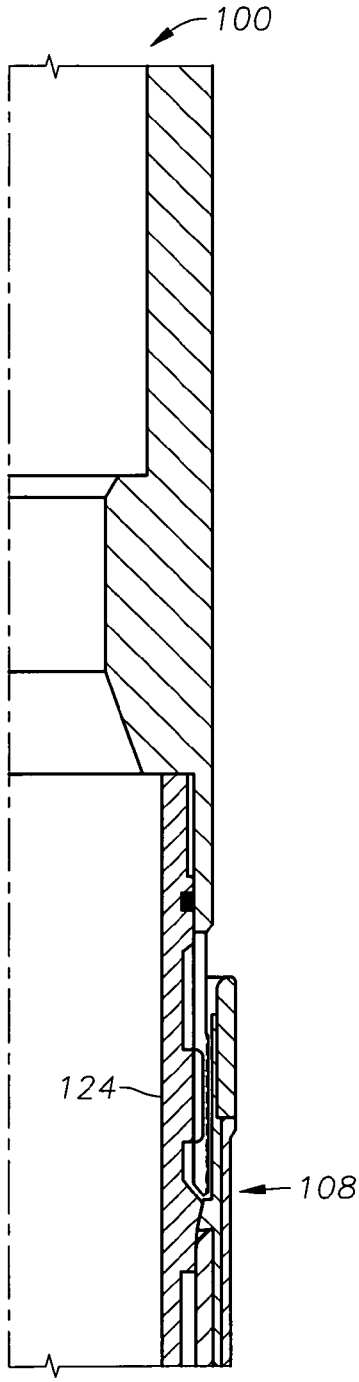
Figure 12F:
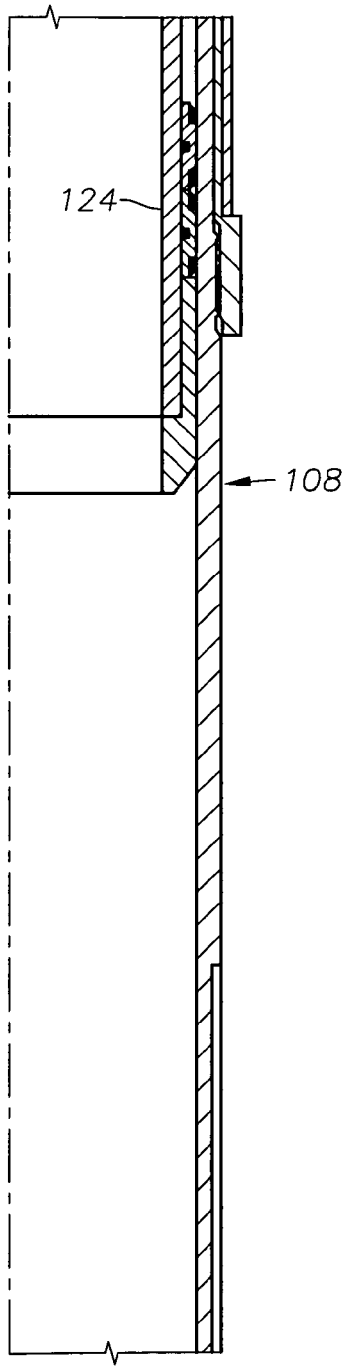
Figure 13A:
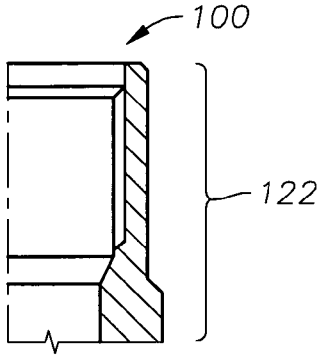
FIGS. 13*a*–13*f* are a quarter-section view of an exemplary reservoir control valve used within the system described with respect to FIGS. 7–11, now with the control valve now actuated to open an inner sliding sleeve.
Figure 13B:
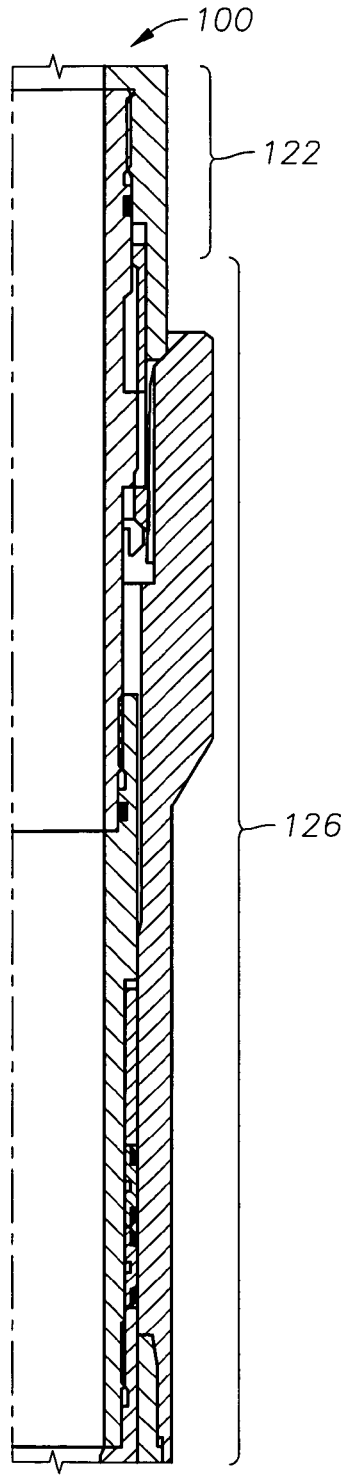
Figure 13C:
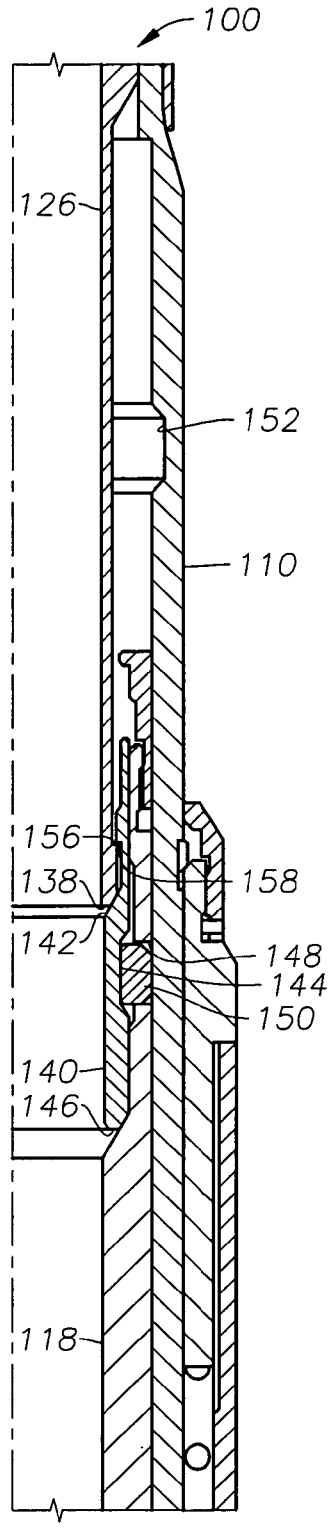
Figure 13D:
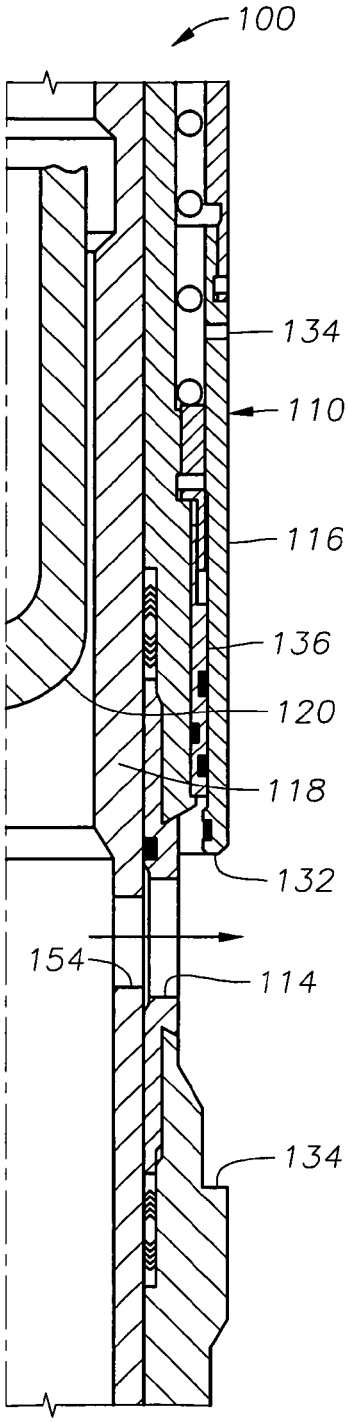
Figure 13E:
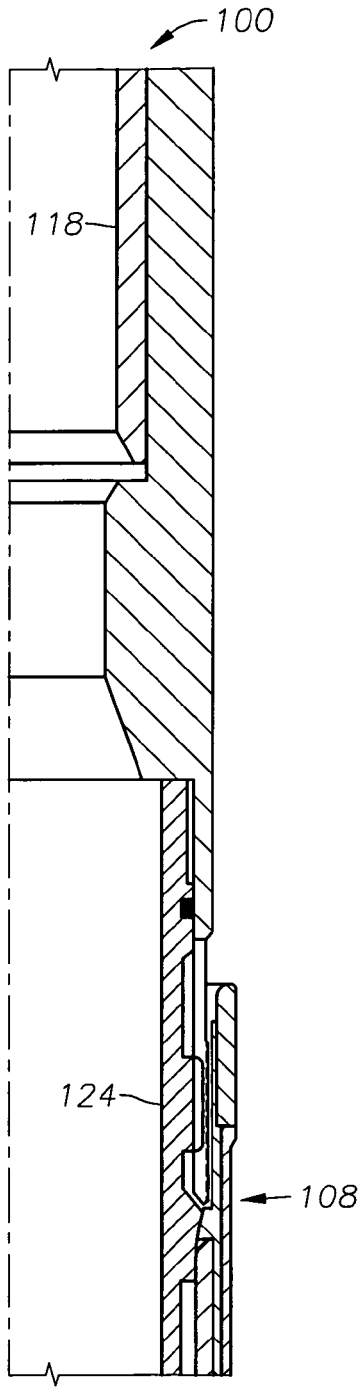
Figure 13F:
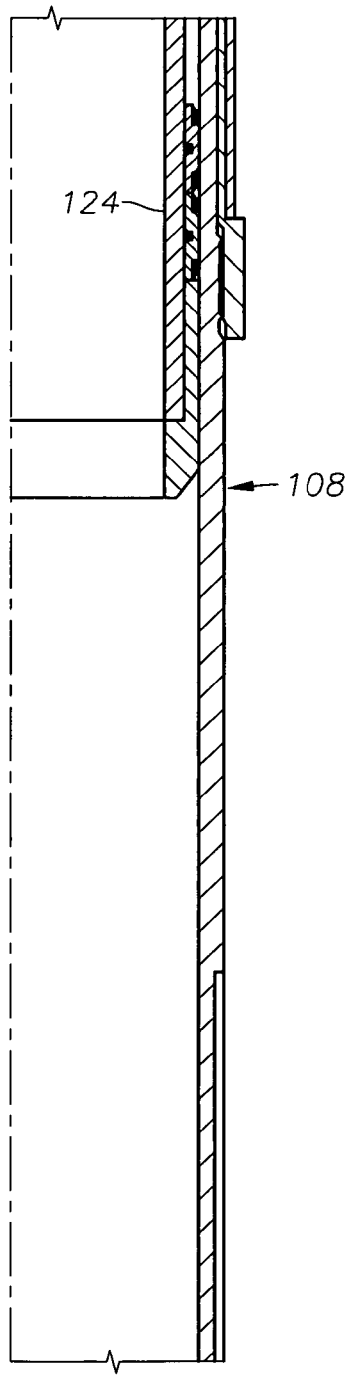

To open the outer sleeve 116, fluid pressure is increased from the surface inside of the upper completion 102 tubing string. Fluid pressure exits the openings 128 in the fluid pump 104 and enters the annulus 130. The pressurized fluid bears upon an annular piston area 132 (see e.g., FIG. 12*d*) to urge the outer sleeve 116 upwardly (see FIG. 10). FIGS. 12*d* and 13*d* depict the assembly 100 after the outer sleeve 116 has already been moved upwardly to a position to where it does not block the port 114. Prior to such movement, the piston area 132 would lie proximate ridge 134 shown in FIG. 12*d*, and the body of the sleeve 116 would, thereby, block the port 114.

Figure 10:
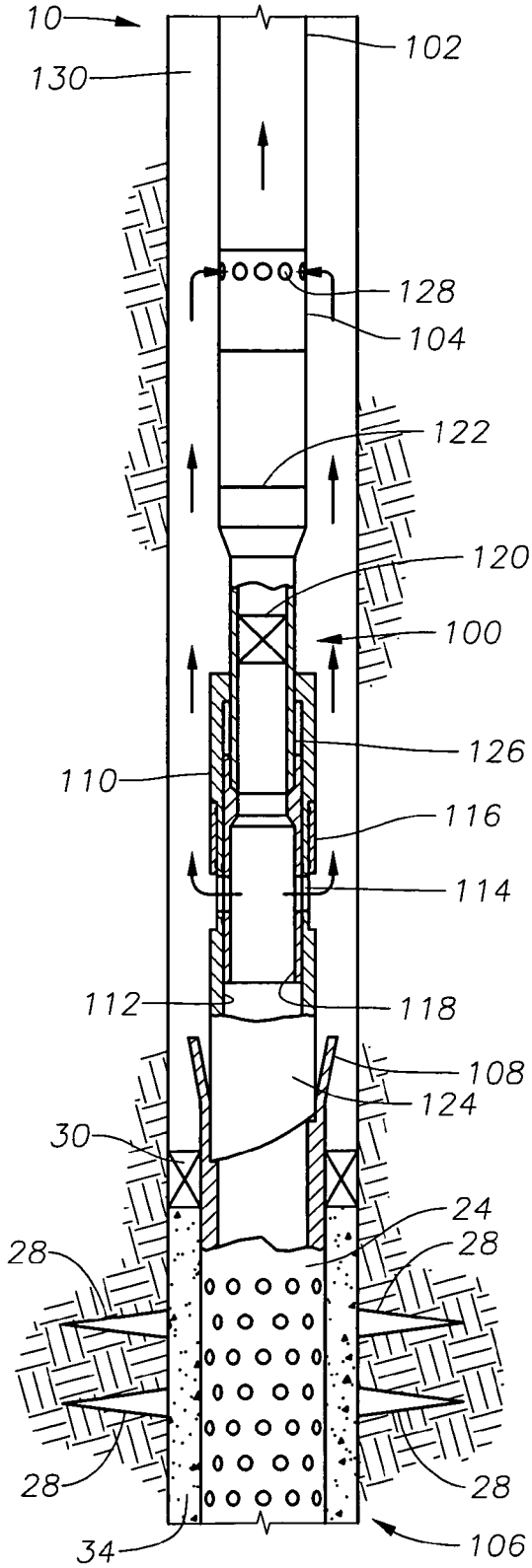
FIG. 10 illustrates the reservoir control system of FIGS. 7–9 now with the outer sliding sleeve opened to permit fluid flow upwardly into the upper completion portion.
Figure 11:
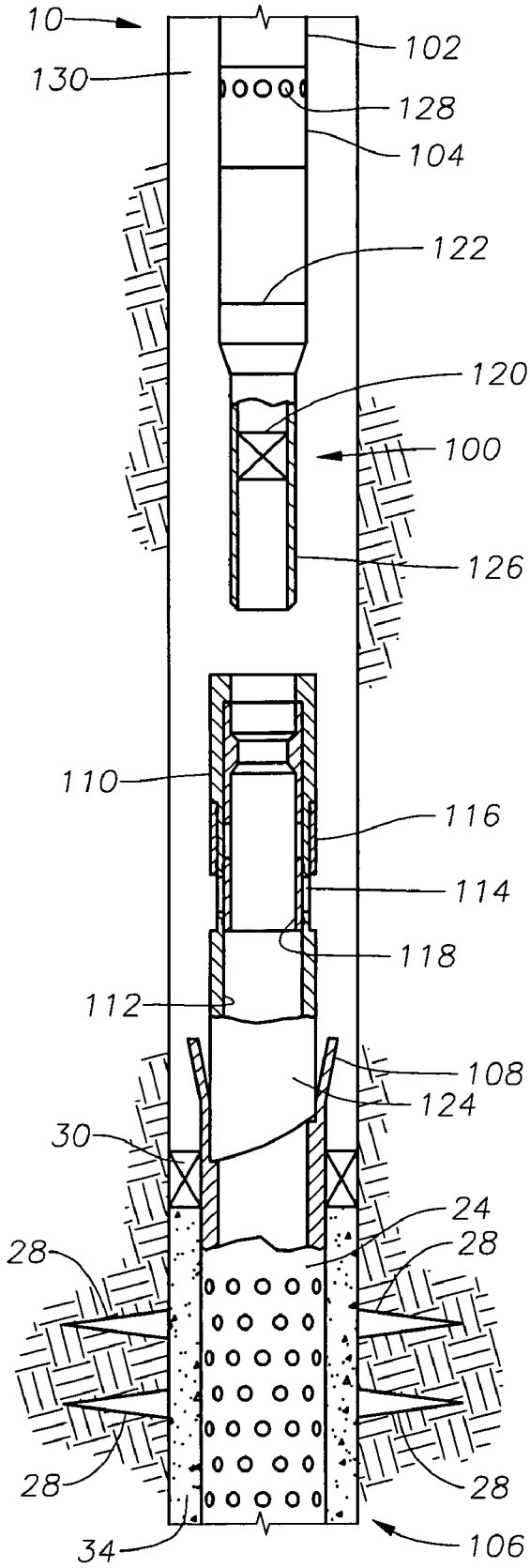
FIG. 11 illustrates the reservoir control system of FIGS. 7–10 now with the upper completion portion being removed from the wellbore.

Once the outer sleeve 116 is moved upwardly to unblock the port 114, fluid flow and production may occur from the lower completion section 106. As the flow arrows in FIG. 10 depict, production fluid will flow radially outwardly through the port 114 and into the annulus 130. From there, the production fluid can enter the fluid inlets 128 of the pump 104 and, from there, upward through the upper completion section 102 to the surface of the wellbore 10. If necessary to obtain good flow, the pump 104 is actuated to assist movement of the production fluid to the surface of the wellbore 10.

When it is desired to cease production from the lower completion section 102, the pump 104 is stopped, and the upper completion section 102 is pulled upwardly. The stinger assembly 126 will engage and move the inner sleeve 118 so that it once again blocks fluid communication through the port 114. Further upward pulling of the upper completion section 102 will cause the valve body 110 to separate so that the upper latch assembly 122 and the stinger assembly 126 are removed, leaving the anchoring portion 124, plug 120 and sleeves 116, 118 within the wellbore 10 and secured to the packer device 30. Fluid flow out of the lower completion section 106 is now blocked by the plug 120 and the closed inner sleeve 118.

If it is desired to reestablish production from the lower completion section 106, the upper completion section 102 may be reinserted into the wellbore 10 and the stinger assembly 126 reinserted into the portion of the valve body 110 that has been anchored to the packer device 30. The stinger assembly 126 will reopen the port 114 by moving the inner sleeve 118 downwardly to a position where it no longer blocks the port 114. Fluid flow, as illustrated in FIG. 10, will be reestablished.

FIGS. 12*a*–12*f* and 13*a*–13*f* provide a detailed illustration of an exemplary reservoir control assembly 100 so that further details of its construction and operation may be seen. In FIG. 12*d*, the assembly 100 is shown with the outer sleeve 116 moved to a position so that it does not block the port 114 from a position (shown in dashed lines) wherein the sleeve 116 does block the port 114. The outer sleeve 116 moves to its open position once the fluid pressure within the annulus 130 applied to the annular piston area 132 exceeds the shear value of the shear pin 134, which secures the outer sleeve 116 to a retaining ring 136 upon the valve body 110. Annulus pressure opening of the outer sleeve 116 is similar to that used in the CMP™ Defender sliding sleeve completion tool, available from Baker Oil Tools of Houston, Tex.

The inner sleeve 118 is initially closed (see FIG. 12*d*) so that the port 114 is blocked. The stinger assembly 126 presents an engagement end 138 that contacts and engages a sleeve release ring 140. The sleeve release ring 140 has an inner engagement shoulder 142 for receiving the engagement end 138 of the stinger assembly 126. The sleeve release ring 140 also features a radially outer lug recess 144 and a lower sleeve-contacting end 146. The inner sleeve 118 includes a lug opening 148, and lug 150 resides within. Valve body 110 also includes a radially-inwardly facing lug recess 152. Initially, the lug 150 is disposed within the lug recess 152, as FIG. 12*c* depicts. The lug 150 is trapped within the outer lug recess 144 by body of the release ring 140. At this point, the lug 150 prevents the inner sleeve 188 from moving with respect to the valve body 110. As the stinger assembly 126 is moved downwardly, the outer lug recess 144 becomes aligned with the lug 150, and the lug 150 moves into the recess 144. The sleeve member 118 may now move axially with respect to the valve body 110 (see FIG. 13*c*). When the sleeve member 118 is moved axially downwardly, under impetus of the stinger assembly 126, a fluid opening 154 in the sleeve member 118 is moved adjacent the port 114, thereby opening the port 114 to fluid passage therethrough.

Upward movement of the upper completion section 102 will cause the stinger assembly 126 to reclose the port 114 against fluid communication before the upper completion section 102 is separated from the lower completion section 106. As the stinger assembly 126 is moved upwardly, upward-facing engagement shoulder 156 (see FIG. 13*c*) on the lower end of the stinger assembly 126 will engage a downward-facing shoulder 158 on the sleeve release ring 140. The sleeve release ring 140 will urge the sleeve 118 upwardly as well, due to the interconnection provided by the lug 150. Further upward movement of the upper completion section 102 will remove the upper latch assembly 122 and the stinger assembly 126 from the other components of the valve assembly 100, leaving them in place in the wellbore 10.

Those of skill in the art will understand that the reservoir control assembly 100 is, in many ways, preferable to the control assembly 25 described earlier, since, for example, it eliminates the need for an outer shroud, such as the shroud 80 used in the first embodiment.

It can be seen that the invention provides systems and methods for selectively closing off a section of a wellbore to fluid communication. The wellbore completion section may then be reopened to fluid communication upon reconnection of the upper completion section to the lower completion section. In the first described embodiment, a secondary fluid pathway may be opened in the event of a failure of the closed wellbore completion section to reopen in the intended manner. Advantageously, the systems and methods of the present invention generally preclude fluid communication between the annulus 18 of the upper completion section 22 and the flowbore of the lower completion section 24 until the lower completion section 24 is closed off to fluid flow.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A reservoir control assembly for use within a wellbore to selectively open and close off a lower completion portion of a well for removal or placement of an upper completion portion, the assembly comprising:

a control valve body with an anchor portion for selectively landing the control valve body into a packer within the wellbore;

a fluid flow port disposed within the valve body;

a first slidable sleeve member that is moveable between an open position, wherein fluid communication through the port is not blocked by the first sleeve member, and a closed position, wherein fluid communication through the port is blocked by the first sleeve member;

a second slidable sleeve member that is moveable between an open position, wherein fluid communication through the port is not blocked by the second sleeve member, and a closed position, wherein fluid communication through the port is blocked by the second sleeve member; and a tubing string positioned in a well having a bore in communication with the fluid flow port for flowing fluid to the surface, the fluid flowing from a well annulus into the bore.

2. The reservoir control assembly of claim 1 wherein the first sleeve is moved between the open and closed positions by a stinger assembly.

3. The reservoir control assembly of claim 1 wherein the valve body is separable.

4. The reservoir control assembly of claim 1 further comprising an outer shroud for containing flow of production fluid.

5. The reservoir control assembly of claim 4 further comprising a frangible burst member within the shroud for selectively providing a secondary fluid flow path.

6. The reservoir control assembly of claim 1 wherein one of said slidable sleeve members is moved to its open position by increase of fluid pressure within an annulus radially surrounding The reservoir control assembly.

7. The reservoir control assembly of claim 1 farther comprising a plug within the valve body to block axial fluid flow through the valve body.

8. A reservoir completion assembly for selective production of production fluid from a lower section of a wellbore, the system Comprising:

a lower completion section formed of tubing string and a packer device for securing the lower completion section within the wellbore:

an upper completion section formed of tubing string having a bore flowing production fluid to the surface, the production fluid flowing from a well annulus into the bore; and having:

an anchor device for selectively latching into said packer device; and a reservoir control valve for controlling flow of fluid from the lower completion, The resorvoir control valve comprising:

a) a control valve body with an anchor portion for selectively landing the control valve body into a packer within the wellbore;

b) a fluid flow port disposed within the valve body;

c) a first slidable sleeve member that is moveable between an open position, wherein fluid communication through the port is not blocked by the first sleeve member, and a closed position, wherein fluid communication through the port is blocked by the first sleeve member; and d) a second slidable sleeve member that is moveable between an open position, wherein fluid communication through the port is not blocked by the second sleeve member, and a closed position, wherein fluid communication through the port is blocked by the second sleeve member.

9. The reservoir completion assembly of claim 8 further comprising a fluid pump incorporated within the upper completion section for assisting flow of fluid from the lower completion section toward a surface of the wellbore.

10. The reservoir completion assembly of claim 8 wherein the first sleeve is moved between the open and closed positions by a stinger assembly.

11. The reservoir completion assembly of claim 8 wherein the valve body is separable.

12. The reservoir completion assembly of claim 8 further comprising an outer shroud for containing flow of production fluid.

13. The reservoir completion assembly of claim 8 further comprising a plug within the valve body to block axial fluid flow through the valve body.

14. The reservoir completion assembly of claim 8 wherein one of said slidable sleeve members is moved to its open position by increase of fluid pressure within an annulus radially surrounding the reservoir control valve.

15. A method of selectively accessing a lower completion portion of a well comprising the steps of:

landing an upper completion section having a reservoir control valve assembly onto the lower completion portion within the wellbore;

moving a first sliding sleeve member upon the reservoir control valve assembly from a closed position to an open position to unblock a fluid port in the valve assembly;

moving a second sliding sleeve member upon the reservoir control valve assembly from a closed position to an open position to unblock the fluid port in the valve assembly; and flowing production fluid from the lower completion portion though a bore of a tubing string toward a surface of the well, the production fluid flowing from a well annulus into the bore.

16. The method of claim 15 further comprising the step of closing off flow of production fluid from the lower completion portion by moving one of said sliding sleeves to block said fluid port.

17. The method of claim 16 further comprising the step of separating the upper completion section from the lower completion section after blocking of said fluid port.

18. The method of claim 15 wherein the step of moving the first sliding sleeve assembly further comprises increasing annulus pressure within the wellbore to exert fluid pressure upon a piston face of said sliding sleeve and cause it to move.

19. The method of claim 15 wherein the second sliding sleeve is moved by a urging of a stinger assembly.

20. The method of claim 15 further comprising the step of operating a fluid pump to assist flow of production fluid from the wellbore.

* * * * *